US009328918B2

(12) United States Patent
Ajdelsztajn et al.

(10) Patent No.: US 9,328,918 B2
(45) Date of Patent: May 3, 2016

(54) COMBUSTION COLD SPRAY

(75) Inventors: Leonardo Ajdelsztajn, Niskayuna, NY (US); James Anthony Ruud, Delmar, NY (US)

(73) Assignee: General Electric Company, Niskayuna, NY (US)

( * ) Notice: Subject to any disclaimer, the term of this patent is extended or adjusted under 35 U.S.C. 154(b) by 382 days.

(21) Appl. No.: 12/790,170

(22) Filed: May 28, 2010

(65) Prior Publication Data

US 2011/0293919 A1 Dec. 1, 2011

(51) Int. Cl.

| | |
|---|---|
| ***C23C 24/04*** | (2006.01) |
| ***F23D 99/00*** | (2010.01) |
| ***C23C 4/12*** | (2016.01) |
| ***F23C 3/00*** | (2006.01) |
| ***F23D 14/52*** | (2006.01) |
| ***F23D 17/00*** | (2006.01) |

(52) U.S. Cl.

CPC ..... *F23D 21/005* (2013.01); *C23C 4/124* (2013.01); *C23C 24/04* (2013.01); *F23C 3/00* (2013.01); *F23D 14/52* (2013.01); *F23D 17/002* (2013.01); *F23D 91/02* (2015.07); *F23C 2900/03005* (2013.01); *Y10T 428/25* (2015.01)

(58) Field of Classification Search

CPC ..... C23C 4/124; C23C 24/04
USPC ..... 427/447
See application file for complete search history.

(56) References Cited

U.S. PATENT DOCUMENTS

| | | | | |
|---|---|---|---|---|
| 4,370,538 A | | 1/1983 | Browning | |
| 5,019,686 A | | 5/1991 | Marantz | |
| 5,262,206 A | * | 11/1993 | Rangaswamy et al. | 427/447 |
| 5,268,045 A | | 12/1993 | Clare | |
| 5,302,414 A | | 4/1994 | Alkhimov et al. | |
| 5,330,798 A | * | 7/1994 | Browning | 427/446 |

(Continued)

FOREIGN PATENT DOCUMENTS

| | | |
|---|---|---|
| EP | 0375931 A2 | 7/1990 |
| JP | 02131160 A | 5/1990 |

(Continued)

OTHER PUBLICATIONS

"Nickel chrome alloys", nickel-alloys.net, 3 pages, accessed Apr. 24, 2012.*

(Continued)

*Primary Examiner* — Katherine A Bareford
(74) *Attorney, Agent, or Firm* — Paul J. DiConza

(57) ABSTRACT

Different types of apparatus for fabricating a deposit, method of deposition and an article are presented. The apparatus include a thermal spray gun comprising a combustion chamber, combustion zone, an air injection port, a fuel injection port, a nozzle and a liquid injection port. The combustion zone exists between the inlet side and outlet side of the combustion chamber. The method includes, among other things, providing a fuel and an oxidizer inside the combustion zone, initiating combustion inside the combustion zone, and directing products of the combustion toward the outlet side to create a combustion product stream. The method also includes introducing a feedstock mixture comprising a feedstock material and a liquid into the combustion product stream to create an entrained feedstock stream, and expelling the entrained feedstock stream from the spray gun through a nozzle to form a deposit on a surface of the article.

13 Claims, 5 Drawing Sheets

(56) References Cited

U.S. PATENT DOCUMENTS

| | | | | |
|---|---|---|---|---|
| 5,447,567 | A * | 9/1995 | Tanaka et al. | 118/303 |
| 5,834,066 | A | 11/1998 | Kunzli et al. | |
| 5,932,293 | A * | 8/1999 | Belashchenko et al. | 427/446 |
| 6,245,390 | B1 * | 6/2001 | Baranovski et al. | 427/449 |
| 6,444,259 | B1 | 9/2002 | Subramanian et al. | |
| 7,229,661 | B2 | 6/2007 | Ruzzo et al. | |
| 7,341,758 | B2 | 3/2008 | Stewart et al. | |
| 7,514,122 | B2 | 4/2009 | Kramer | |
| 7,553,385 | B2 | 6/2009 | Haynes | |
| 2003/0049384 | A1 | 3/2003 | Liu et al. | |
| 2006/0166020 | A1 * | 7/2006 | Raybould et al. | 428/471 |
| 2006/0213326 | A1 | 9/2006 | Gollob et al. | |
| 2006/0222777 | A1 | 10/2006 | Skoog et al. | |
| 2007/0138147 | A1 * | 6/2007 | Molz et al. | 219/121.47 |
| 2008/0072790 | A1 * | 3/2008 | Ma et al. | 106/286.3 |
| 2011/0086178 | A1 * | 4/2011 | Ruud et al. | 427/447 |

FOREIGN PATENT DOCUMENTS

| | | | |
|---|---|---|---|
| JP | 02221362 | A | 9/1990 |
| JP | 2005248288 | A | 9/2005 |
| WO | 2006116844 | A1 | 11/2006 |
| WO | 2007082210 | A1 | 7/2007 |
| WO | 2009155702 | A1 | 12/2009 |

OTHER PUBLICATIONS

Dongmo, et al "Numerical approach and optimization of the combustion and gas dynamics in High Velocity Suspension Flame Spraying (HVSFS)", Surfaces & Coatings Technology 203 (2009), pp. 2139-2145.*

Schmidt et al., "From Particle Acceleration to Impact and Bonding in Cold Spraying", Journal of Thermal Spray Technology, vol. No. 18, Issue No. 5-6, pp. 794-808, Dec. 2009.

Japanese Office Action issued in connection with corresponding JP Application No. 2011116459 on Mar. 3, 2015.

* cited by examiner

1μm

1μm

COMBUSTION COLD SPRAY

BACKGROUND

The invention relates generally to combustion cold spray and, in particular, to the apparatus for and methods of combustion cold spray.

Bonded surface layers are desired for many applications including those in which the surfaces experience corrosion, erosion, or high temperature. Bonded surface layers can be produced through cladding processes in which a metal feedstock is melted along with the surface layer of the substrate and resolidified to produce a bonded attachment interface. Cladding processes, particularly for high temperature alloys, can be time-consuming processes that entail considerable expense, and they require a substantial heat input into the part.

Another method used for producing bonded metallic coatings on substrates is cold spray technology. In cold spray technology (also referred to herein as simply "cold spray"), particles are mixed with a gas and the gas and particles are subsequently accelerated into a supersonic jet, while the temperature of the gas and particles is maintained at a sufficiently low temperature to prevent melting of the particles. Copper coatings have been deposited using cold spray in which sufficient bonding was achieved to produce bulk-like properties. However, higher temperature materials such as stainless steel, nickel, nickel-based superalloys and titanium alloys, are likely to require higher velocities to produce high quality deposits with limitations of conventional cold spray devices. In particular, achieving higher particle and deposit temperatures would be desirable.

Bonded deposits produced from particle deposition processes would be more economical than cladding processes, and would enable near net shape forming at a high deposition rate. Cold spray deposition processes are currently limited in the degree of particle consolidation because of temperature limitations in the gas. In order to attain better properties using higher melting point metals than copper, cold spray equipment is moving toward higher gas temperatures.

Combustion thermal spray devices are currently used to produce metallic coatings through particle melting or partial melting and acceleration onto a substrate. They use a combustion process to produce gas temperatures above the melting point of the particles and gas pressures to impart velocity to the particles.

One common problem encountered in the combustion thermal spray process is the susceptibility of the sprayed metal powder to oxidation. It is important to reduce the amount of oxygen present in the metal coating to improve the formability of the coating, to make the coating less brittle, and to improve corrosion resistance. Some normally used methods to reduce the oxygen content in the coatings include thermally spraying the metal powder in a chamber filled with an inert gas, such as nitrogen, and using an inert gas shroud to protect the molten powder from oxidation during the thermal spray process.

Therefore, there is a need for creating a bonded deposit that is more cost-effective than cladding and able to produce higher quality deposits more economically than cold spray for high temperature metals. Further, it is desirable to have a method of depositing high quality metal coatings that result in the metal coating having a low oxygen level without requiring the additional step of annealing.

BRIEF DESCRIPTION

Briefly, in one embodiment, an apparatus for fabricating a deposit is described. The apparatus comprises a high-velocity-air-fuel (HVAF) gun comprising a combustion chamber, combustion zone, an air injection port, a fuel injection port, a permeable burner block, a nozzle and a liquid injection port. The combustion chamber has an inlet side and an outlet side such that the combustion zone exists between the inlet side and outlet side of the combustion chamber. The air injection port is disposed in the inlet side of the combustion chamber and configured to inject air to the combustion zone. The fuel injection port is disposed in the inlet side of the combustion chamber and configured to inject fuel to the combustion zone. The permeable burner block is disposed in the combustion zone. The nozzle is disposed in the outlet side of the combustion chamber. The liquid injection port is connected to a source of liquid and disposed axially in the combustion chamber through the inlet side.

In one embodiment, an apparatus for fabricating a deposit is described. The apparatus comprises a source of feedstock material, a source of liquid, a combustion chamber, a combustion zone, a fuel injection port, an oxidizer injection port, a nozzle, and a coaxial tube injection port. The combustion chamber has an inlet side and an outlet side and has the combustion zone between the inlet side and outlet side. The fuel injection port is disposed in the inlet side of the combustion chamber and configured to inject fuel to the combustion zone. The oxidizer injection port is disposed in the inlet side of the combustion chamber and configured to inject oxidizer to the combustion zone. The nozzle is disposed in the outlet side of the combustion chamber. The coaxial tube injection port comprises an inner tube and an outer tube and is disposed in the inlet side of the combustion chamber such that the coaxial tube injection port is connected to both the source of feedstock material and source of liquid.

In one embodiment, a method of forming an article with a deposit is provided. The method comprises providing a spray gun comprising a combustion chamber that has an inlet side and an outlet side and a combustion zone in between the inlet side and outlet side. The method further comprises providing a permeable burner block in the combustion zone, providing a fuel and an oxidizer inside the combustion zone, initiating combustion inside the combustion zone, and directing products of the combustion toward the outlet side to create a combustion product stream. The method also includes introducing a feedstock mixture comprising a feedstock material and a liquid into the combustion product stream to create an entrained feedstock stream, and expelling the entrained feedstock stream from the spray gun through a nozzle to form a deposit on a surface of the article.

In one embodiment, an article is described. The article comprises a substrate and a deposit on the substrate. The deposit includes a plurality of feedstock particles bonded along their prior particle boundaries, in which the particles have a median size less than about 10 microns.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
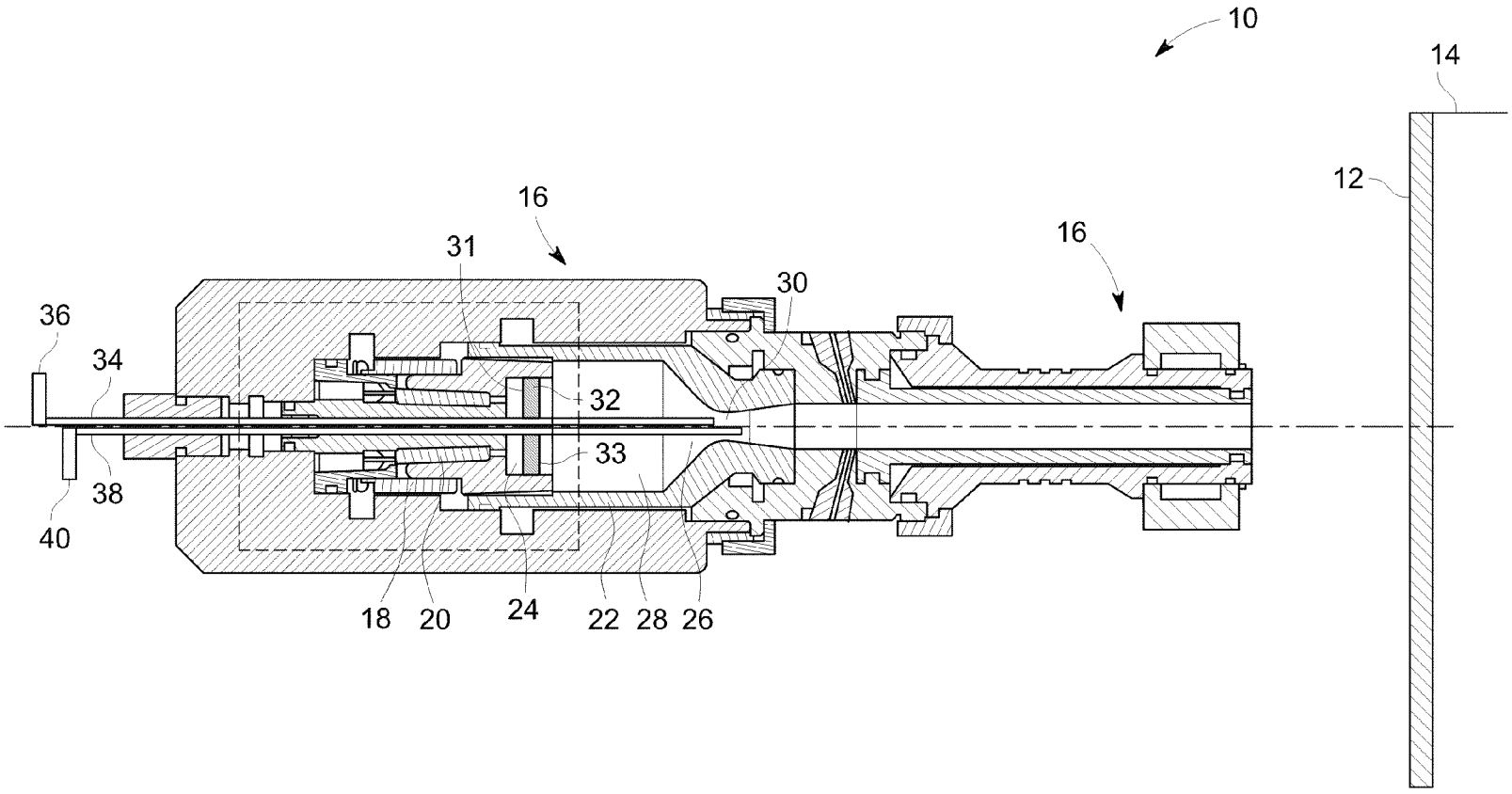
FIG. 1 illustrates an HVAF apparatus according to an embodiment of the invention.

Embodiments of the present invention include the apparatus and method for producing a fine-grained, dense metal deposit on a substrate from solid state impact deposition with bonded particles using a combustion thermal spray device with fine particle metal feedstock.

In the following specification and the claims that follow, the singular forms "a", "an" and "the" include plural referents unless the context clearly dictates otherwise.

The term "bonded", as used herein means in contact with and adhered to. "Bonding" may be between the deposited particles and/or between the deposited particles and the substrate/base particles. The term "reducing oxygen content", as used herein means reducing the final oxygen content in the metal or alloy deposit by using the apparatus and method described herein, when compared to the other conventional metal/alloy deposition apparatus and techniques. A "deposit" is a bulk or layer on a substrate/base. In a specific embodiment, the deposit is a coating. A "liquid injection port" is a port to inject a fluid comprising a liquid, such as a liquid or a liquid-containing mixture, such as a liquid-solid mixture or a liquid-gas mixture, for example.

Typical thermal spray coatings or deposits are produced by melting of the particles and resolidification on the substrate. In this process, a feedstock material, usually provided in a power or wire form, is heated to an elevated temperature in a spray device. The feedstock material may be entirely melted to form liquid droplets, may be partially melted to form semi plastic particles, or may be unmelted solid powder particles. The heated feedstock material is ejected from the spray device at a high velocity and thence sprayed against a substrate article surface. The sprayed material deposits upon the surface and, to the extent that it is liquid, solidifies. The droplets and particles impact the surface at a high velocity, and are flattened against the surface. The deposition continues until the solidified deposit reaches a desired thickness, often as great as about few millimeters.

Thermal spray processes often use combustion of fuel with an oxidizer to provide the heat to the feedstock material. Combustion processes can be based on periodic combustion from detonation or on continuous combustion. Two combustion thermal spray processes, high velocity oxygen fuel (HVOF) and high velocity air fuel (HVAF) techniques, are some times used to apply deposits. In each technique, a gas or liquid fuel is combusted with oxygen (HVOF) or air (HVAF) to produce a high velocity exhaust stream. A feedstock powder injected into the exhaust stream is heated and accelerated toward the desired substrate at sonic or supersonic speeds. The resulting deposit typically has a higher density compared to other thermal spray application techniques. However, feedstock particles having an average diameter smaller than about 15-20 microns tend to clog or agglomerate in conventional HVOF and HVAF equipment affecting feeding rate and quality of the deposit.

Further, the HVOF process, by the nature of combustion with oxygen, produces very high combustion temperatures that result in high particle temperatures. Carbide particles can undergo oxidation or dissolution in the metallic binder matrix, which can affect the properties of the coatings. The HVAF process, in contrast, operates in a process range described in the art as "warm kinetic spraying" with reduced combustion and particle temperatures. The coatings produced by HVAF processes using relatively large powder feedstock material have been observed to contain lower oxygen compared with HVOF coatings, which is particularly advantageous when spraying fine particles. However, reduced combustion temperatures can limit the mechanical strength of the deposits because of reduced bonding among particles.

In one embodiment of the present invention, an apparatus for fabricating a deposit is presented. The apparatus uses an HVAF gun to fabricate a deposit. The apparatus is explained using an example drawing, described and referenced below. Each example provided herein is by way of explanation of the invention, not to be considered as the limitation of the invention. It will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 shows a simplified diagram of an apparatus 10 for applying a deposit 12 to a substrate 14 according to one embodiment of the present invention. The system 10 includes an HVAF spray gun 16. Although various HVAF spray guns are known in the art and may be used within the scope of various embodiments of the present invention, the spray gun 16 shown in FIG. 1 for the purposes of this example includes a plurality of circumferentially spaced air injection ports 18 and fuel injection ports 20, that feed air and fuel (gas or liquid) respectively, to a combustion chamber 22. The spray gun 16 ignites the fuel/air mixture in the combustion chamber 22, and the chamber 22 has an inlet side 24 and outlet side 26. A combustion zone 28 exists between the inlet side 24 and outlet side 26 of the combustion chamber 22. A nozzle 30 disposed in the outlet side 26 of the combustion chamber 22 accelerates the combustion gases to high velocities. The nozzle 30 may have different geometries. The velocities of the combustion gases are typically in excess of about 600 meters per second.

The temperature and velocity of the deposited particles may be adjusted to get a bonding of the coating 12 on the substrate 14, without significant splashing or sputtering. Therefore, at higher velocities of the combustion gases, lower temperature of the combustion gases may be used to create the impact. In one embodiment, the combustion chamber 22 includes a permeable burner block 32, with an upstream face 31 and downstream face 33, disposed in the combustion chamber 22 that helps in generating a high-velocity combustion gas stream. In one embodiment, the permeable burner block 32 is disposed in the combustion zone 28 of the combustion chamber 22. In one embodiment, the permeable burner block 32 receives the fuel from the fuel injection ports 20 and helps in efficient combustion of the fuel to create a high velocity combustion gases. In one embodiment, the permeable burner block 32 includes a plurality of orifices (not shown) that help in transporting the fuel for efficient combustion in the combustion zone 28. In one embodiment, the permeable burner block 32 comprises a ceramic material. In one embodiment, the permeable burner block 32 is a catalytic plate.

In one embodiment, the HVAF gun further includes a liquid injection port 34 connected to a source of liquid 36 and disposed in the combustion chamber through the inlet side 24.

The liquid injection port 34 can be placed circumferentially, axially or in an oblique angle to the nozzle 30. In one embodiment, the liquid injection port 34 is placed axially in the HVAF spray gun 16. In another embodiment, as shown in FIG. 1, the HVAF spray gun 16 includes the liquid injection port 34 in the centerline axis of the combustion chamber 22.

In one embodiment, the HVAF spray gun further includes a feedstock injection port 38 connected to a feedstock source 40. The feedstock injection port 38 can be placed circumferentially, axially or in an oblique angle to the combustion chamber 22. In one embodiment, as shown in FIG. 1, the spray gun 16 includes feedstock injection port 38 disposed axially to the combustion chamber 22. In one embodiment, the feedstock injection port 38 supplies the feedstock material into the flow of combustion gases. The combustion gases accelerate the feedstock material and the feedstock material exits the HVAF spray gun 16 to produce the coating 12 on the substrate 14.

The liquid injection port 34 supplies a liquid material that disperses the feedstock material that gets injected into the stream of combustion gases in the spray gun 16 to overcome the difficulties experienced with supplying small-sized particles in conventional coating apparatus. In one embodiment, the feedstock material or mixture is mixed with the liquid in the source of liquid 36 and injected to the combustion gas stream through the liquid injection port 34. In another embodiment, the liquid and feedstock mixture is co-injected to the combustion gas stream separately through the liquid injection port 34 and feedstock injection port 38.

Suitable liquids for dispersing the feedstock material include, for example, water, alcohol, an organic combustible liquid, an organic incombustible liquid, or combinations thereof. Specific examples of suitable liquids for dispersing the feedstock material composition include water, ethanol, methanol, isopropanol, butanol, hexane, ethylene glycol, glycerol or combinations thereof. The reduced average particle size of the feedstock particles dispersed in the liquid allows the system 10 to produce a resulting coating 12 with an average particle size less than approximately 16 microns, and in particular embodiments less than approximately 5 microns, and, in certain embodiments, less than 2 microns.

Depending on the feedstock material, fuel, temperature of the combustion, and the velocity of the combustion streams, along with other variables, the location of the tip of the liquid injection port 34 that disposes liquid or liquid—feedstock mixture to the combustion stream varies. In one embodiment, the liquid injection port 34 extends up to the downstream face 33 of the permeable burner block 32. In another embodiment, the liquid injection port 34 extends into the combustion zone 28 between the permeable burner block 32 and the nozzle 30. In yet another embodiment, the liquid injection port 34 extends through the combustion zone 28 into the nozzle 30.

Figure 2:
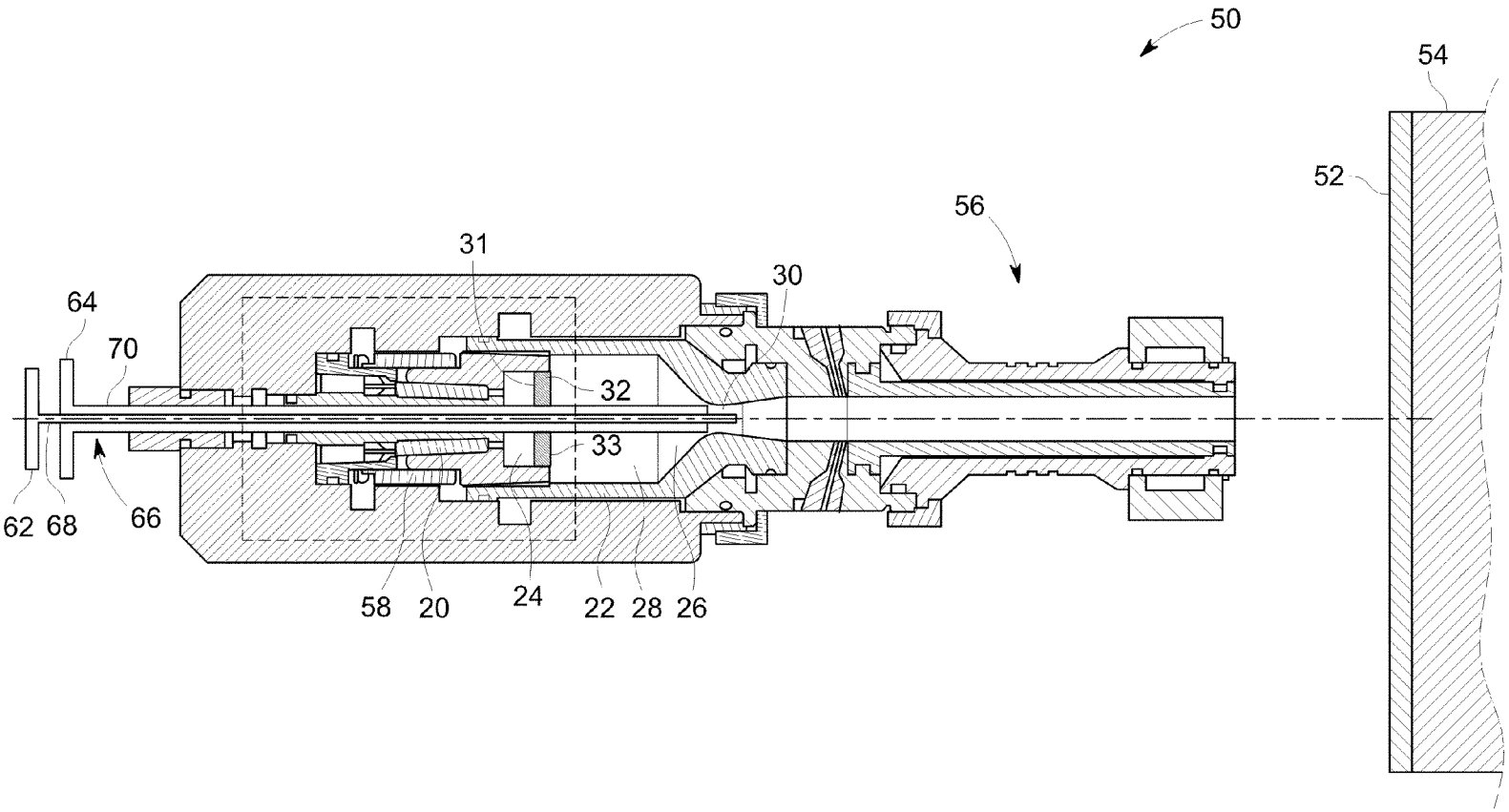
FIG. 2 illustrates an apparatus for fabricating a deposit according to an embodiment of the invention.

In one embodiment of the present invention, an apparatus 50 for fabricating a deposit is presented as in the example described in FIG. 2. The apparatus 50 may use any spray gun, including, for example, HVAF or HVOF guns. Similar to the apparatus described in FIG. 1, apparatus 50 can also be used for applying a coating 52 to a substrate 54 according to one embodiment of the present invention. The system 50 includes a spray gun 56. Although various spray guns are known in the art and may be used within the scope of various embodiments of the present invention, the example spray gun 56 shown in FIG. 2 includes a plurality of circumferentially spaced oxidizer injection ports 58 and fuel injection ports 20, that feed oxidizer and fuel (gas or liquid) respectively, to a combustion chamber 22. The oxidizer can be air or oxygen, or combinations thereof. The spray gun 56 ignites the fuel/oxidizer mixture in the combustion chamber 22 that has an inlet side 24 and outlet side 26. A combustion zone 28 exists between the inlet side 24 and outlet side 26 of the combustion chamber 22. Similar to FIG. 1, a nozzle 30 disposed in the outlet side 26 of the combustion chamber 22 accelerates the combustion gases to high velocities.

A source of feedstock material 62 and a source of liquid 64 are disposed in the apparatus 50 to provide the feedstock material and liquid respectively, to the combustion chamber 22. In one embodiment, a coaxial tube injection port 66 comprising an inner tube 68 and an outer tube 70 are disposed in the inlet side of the combustion chamber 22. In one embodiment, the coaxial injection port 66 is connected to both the source of feedstock material 62 and the source of liquid 64. In one embodiment, the inner tube 68 of the coaxial injection port 66 is connected to the source of feedstock material 62 and the outer tube 70 is connected to the source of liquid 64. In one embodiment, the inner tube 68 of the coaxial injection port 66 is used to pass the feedstock material along with a gas or air, for dispersion.

In one embodiment, the coaxial injection port 66 comprises more than two coaxial tubes. In one embodiment, the apparatus 50 comprises more than one coaxial injection ports 66. In one particular embodiment, the apparatus 50 works with an HVOF spray gun. In another particular embodiment, the apparatus 50 comprises a permeable burner block 32 disposed in the combustion chamber 22 that helps in generating a high-velocity combustion gas stream. In one embodiment, the permeable burner block 32 is disposed in the combustion zone 28 of the combustion chamber 22. In a further embodiment, the apparatus 50 comprises an HVAF gun. Similar to the apparatus 10 in FIG. 1, in one embodiment, the permeable burner block 32 receives the fuel from the fuel injection ports 20 and helps in efficient combustion of the fuel to create a high velocity combustion gases. In one embodiment, the permeable burner block 32 includes a plurality of orifices that help in transporting the fuel for efficient combustion in the combustion zone 28. In one embodiment, the permeable burner block 32 comprises a ceramic material. In one embodiment, the permeable burner block 32 is a catalytic plate.

In one embodiment, a method of forming an article with a deposit is presented. The method, alternately called "combustion cold spray method" includes providing a deposit-fabricating apparatus (10, 50) as in FIG. 1 or FIG. 2, for example, comprising the combustion chamber 22, fuel 20 and oxidizer (18, 58) injection ports and liquid (34, 70) and feedstock (38, 68) injection ports. In one embodiment, the spray gun used for the deposit is an HVAF gun. In one embodiment, the fuel or the combustible fluid comprises propylene, propane, methane, butane, natural gas, hydrogen or any mixtures of the foregoing gases. The oxidizer may be air or oxygen.

The method further includes providing a permeable burner block 32 in the combustion zone 28 and initiating the combustion in the combustion zone after transporting the fuel and oxidizer to the combustion zone. The products of the combustion are then directed towards the outlet side 26 to create a combustion product stream. The feedstock mixture and liquid are introduced into the combustion product stream to create an entrained feedstock stream and the entrained feedstock stream is expelled from the spray gun (10, 50) through a nozzle 30 to form a deposit on a surface of the article.

In one embodiment, the method of combustion cold spray presented here is different from the conventional cold spray because of the temperature of the gases and the method for accelerating the gas to supersonic velocities. In conventional cold spray gas is heated by external electrical heating and is accelerated by high pressures, while in combustion cold spray, the gas is heated by the chemical reaction during combustion and is accelerated using expansion of the combustion by-product. In conventional cold spray, the heated gas is maintained below the melting temperature of the particles. In one embodiment, in combustion cold spray, the combustion gases are heated above the melting temperature of the particles, but the liquid being injected via liquid injection port 34 or 70 maintains the particles at a temperature below their melting point.

In one embodiment, the method of combustion cold spray presented here is different from the conventional combustion thermal spray methods that are normally used to produce metallic coatings. The conventional thermal spray provides the metallic coating through particle melting or partial melting and accelerating onto a substrate. The conventional combustion thermal spray uses the combustion process to produce gas temperatures that are above the melting point of the particles.

In the combustion cold spray method presented in one embodiment of the present invention, a liquid medium is incorporated to produce high velocity, hot particles of the feedstock that do not melt and which form dense deposits with bonded particles. The incorporation of a liquid carrier for the feedstock material also makes the method more tolerant to the use of fine particles to produce deposits consisting largely of unmelted and bonded particles. The method, by permitting the unmelted particles to be deposited, reduces the tendency toward oxidation of the particles during deposition and, therefore, tends to incorporate lower oxygen content in the deposits compared to conventional combustion spray processes.

In one embodiment of the method, a mixture formed by mixing the carrier liquid and the feedstock material results in a feedstock mixture comprising at least 10 wt % of liquid. In a further embodiment, the feedstock mixture comprises at least 50 wt % of liquid. In a particular embodiment, the mixture comprises at least 80 wt % of liquid. The carrier liquid of the liquid/solid mixture can be water, an alcohol or any other organic solvent or combinations of these liquids. In one embodiment, the liquid comprises water, organic liquids, oils, alcohols, or any combinations including one or more of these.

In one embodiment, the feedstock mixture is produced from mixing the feedstock material and liquid before being injected into the spray gun. In another embodiment, the feedstock mixture is produced by mixing the feedstock material and liquid in the combustion chamber after being injected into the spray gun.

As discussed previously, in one embodiment of the combustion cold spray method presented herein, the feedstock material does not melt at the time of spraying. In one embodiment, the melting point of the feedstock material is above the temperature experienced by the feedstock material during spraying. In a further embodiment, the temperature experienced by the feedstock material is below about 0.9 times the melting point of the feedstock material.

In one embodiment of the combustion cold spray method presented herein, the feedstock material comprises a metal, or a metal alloy. Examples include metals such as nickel, cobalt, titanium, aluminum, zirconium, and copper. Examples of metal alloys include nickel-base alloys, cobalt-base alloys, titanium-base alloys, iron-base alloys, steels, stainless steels, and aluminum-base alloys. A non-limiting example of a nickel-base alloy is Alloy 718, having a specification composition, in weight percent, of from about 50 to about 55 percent nickel, from about 17 to about 21 percent chromium, from about 4.75 to about 5.50 percent columbium plus tantalum, from about 2.8 to about 3.3 percent molybdenum, from about 0.65 to about 1.15 percent titanium, from about 0.20 to about 0.80 percent aluminum, 1.0 percent maximum cobalt, and balance iron totaling 100 percent by weight. Small amounts of other elements such as carbon, manganese, silicon, phosphorus, sulfur, boron, copper, lead, bismuth, and selenium may also be present. In one embodiment the feedstock material comprises a first metal and a second phase comprising a metal, an alloy, a ceramic or a polymer. A deposit resulting from such a feedstock material, in one embodiment, includes a metal matrix composite. The metal matrix composite includes a matrix phase comprising a metal or metal alloy and a secondary phase, often a reinforcing phase, dispersed within the matrix and comprising metals, alloys, ceramics or polymer materials. In one embodiment, the feedstock material comprises a metal matrix composite having a metal alloy matrix and a ceramic secondary phase.

Feedstock materials with different particle sizes can be used in the combustion cold spray method presented herein to form strong and dense deposits. As a result of using a liquid carrier and lower temperature gases as the combustion gas stream, much finer particles than that can be used in the normal thermal spray method can be used in the combustion cold spray method to form the deposits. In one embodiment, the median particle size of the feedstock material that is used in the combustion cold spray method is less than about 100 microns. In one embodiment, the median particle size of feedstock material is less than about 30 microns. In a further embodiment, the median particle size of feedstock material is less than about 16 microns.

In one embodiment, the article on which the deposit is formed is prepared for receiving the deposit. Preparing the article surface for the combustion cold spray may include cleaning and/or degreasing the surface. In one embodiment, a prepared region of the article surface is formed by removing the existing material or layer such as an oxide layer for example, from the surface of the article so that the deposit formed by directing the feedstock material through combustion cold spray is bonded to the article.

In one embodiment, the article is a part of an apparatus where an existing coating has degraded and has to be repaired. In one embodiment, a deposit or coating is used to replace claddings, to provide structural surface layers, or to form near-net shape components and features on components. The combustion cold spray may be used with a wide variety of compositions and substrate articles, yielding a variety of different types of properties. In one example, to build up an article that has been partially worn away during prior service, the coating material may have the same composition as the substrate article. In another example, to provide a wear-resistant coating at the surface, the coating has a different composition than the substrate article and is more wear resistant than the substrate article. In yet another example, to provide a wearing or abradable coating at the surface, the coating has a different composition than the substrate article and is less wear resistant than the substrate article.

Figure 3:
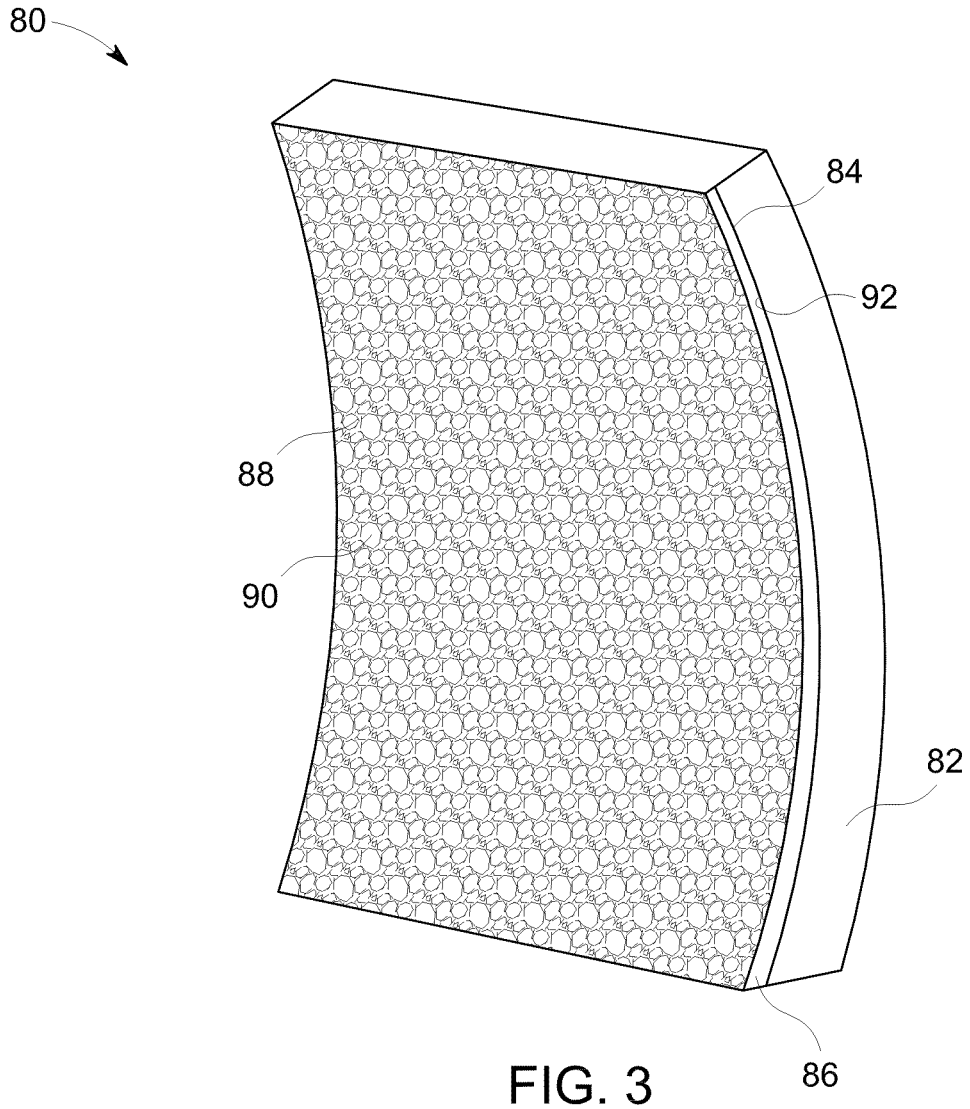
FIG. 3 illustrates an article with a deposit according to an embodiment of the invention.

In one embodiment of the invention, an article is provided. The article may be of any operable shape, size, and configuration. Examples of articles of interest include areas of components of gas turbine engines such as seals and flanges, as well other types of articles. The article 80, as shown in FIG. 3 for example, is formed when a deposit is formed on a substrate 82 of the article 80. The substrate 82 has a depositing surface 84. The deposit 86 is formed on the surface 84 of article 80. The deposit 86 has a plurality of feedstock particles 88 bonded along their prior particle boundaries 90. A surface of contact between the deposited material 86 and the substrate 82 surface 84 is a bondline 92.

Optionally, the article 80 may be heat treated after the combustion cold spray. Any operable heat treatment such as, for example, annealing may be used. The heat treatment may cause the deposit material 86 to interdiffuse to some degree with the substrate 82 material of the article 80. In one embodiment, the particles used for the feedstock have a median size less than about 10 microns. In a further embodiment, the particles have a median size less than about 5 microns. In a still further embodiment, the particles have a median size less than about 2 micron. In one embodiment, the deposit 86 of article 80 has a density greater than about 95% of theoretical density of the deposit material. In a further embodiment, the deposit 86 has a density greater than about 99% of theoretical density.

EXAMPLES

The following examples illustrate methods, materials and results, in accordance with specific embodiments, and as such should not be construed as imposing limitations upon the claims. All components are commercially available from common chemical suppliers.

Example 1

Figure 4:
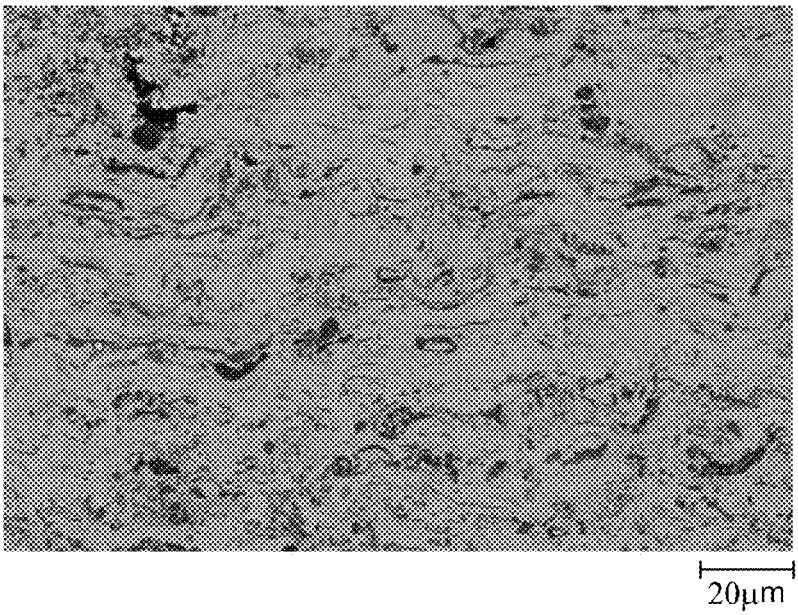
FIG. 4 illustrates a cross sectional SEM of a deposit, using a thermal spray method.

A nickel deposit was made by an apparatus using Kermatico 9300 HVAF thermal spray gun. An alloy IN718 was used as the substrate and nickel powder of about 3-7 μm size obtained from Alfa Aesar was used as the feedstock material. Propylene fuel was supplied to the gun at 83 psig and air was supplied at 85 psig. The combustion pressure was adjusted to be about 70 psi. The gun was operated with a gun traversal speed of about 0.8 m/s at a spray distance of 6-7 cm from the substrate. The deposit was made to be about 200 microns thick. A cross-sectional scanning electron microscopy (SEM) image was taken in back-scattered electron mode. The resultant SEM in FIG. 4 showed that the deposit consisted primarily of molten splats that had resolidified. A large degree of oxide inclusions is apparent from the SEM figure.

Figure 5:
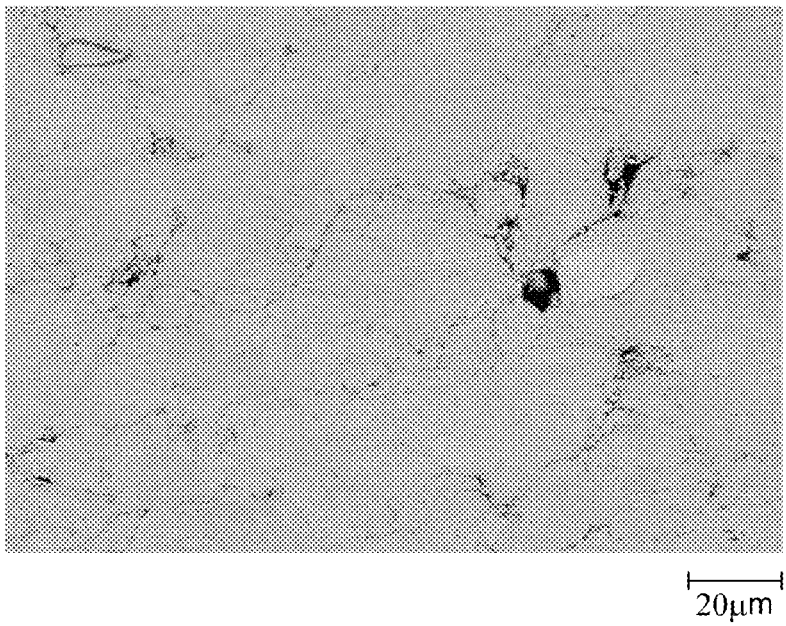
FIG. 5 illustrates a cross sectional SEM of a deposit, according to one embodiment of the invention.

A second nickel deposit was made on an IN718 substrate using a slurry of 10 wt % of 3-7 μm size Alfa Aesar nickel powder in water using a SB9300 HVAF gun manufactured by Unique Coat Technologies, Oilville, Va., USA. Propylene fuel was supplied to the gun at 83 psig and air was supplied at 85 psig. The combustion pressure was 70 psi. The gun was operated with a gun traversal speed of about 0.8 m/s at a distance of 6-7 cm from the substrate. The deposit was made to be about 200 microns thick. An SEM image taken in back-scattered electron mode (FIG. 5) showed that the deposit consisted primarily of bonded particles that had not previously melted. The average particle size was about 4 microns.

Example 2

Figure 6:
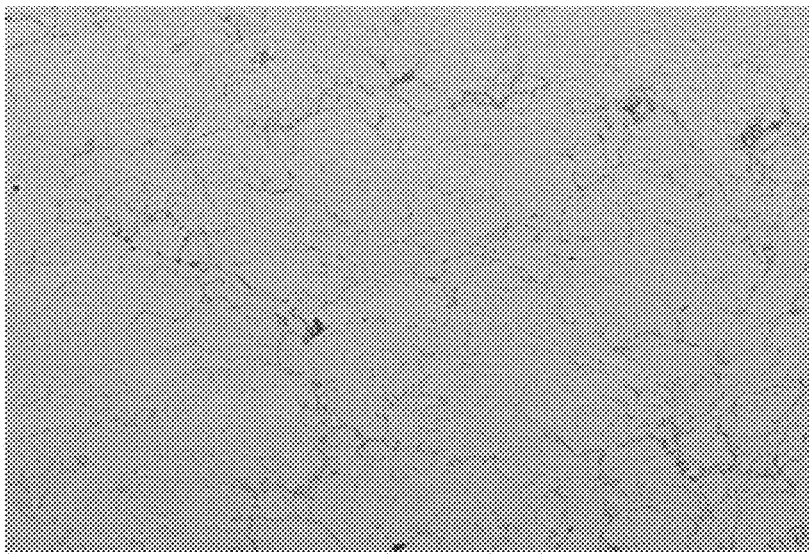
FIG. 6 illustrates a cross sectional SEM of a deposit, according to another embodiment of the invention.

Nickel was deposited on stainless steel substrate using a slurry of 10 wt % of 2-3 μm size nickel powder in water. Propylene fuel was supplied to the gun at 83 psig and air was supplied at 85 psig. The combustion pressure was 70 psi. The gun was operated with a gun traversal speed of about 1.2 m/s at a distance of 6-7 cm from the substrate. About 8 microns were deposited per pass and the total deposit thickness was made to be about 480 microns. A cross-sectional SEM image in FIG. 6 showed that the deposit consisted primarily of bonded particles that had not previously melted. The average particle size was about 2 microns.

Example 3

Figure 7:
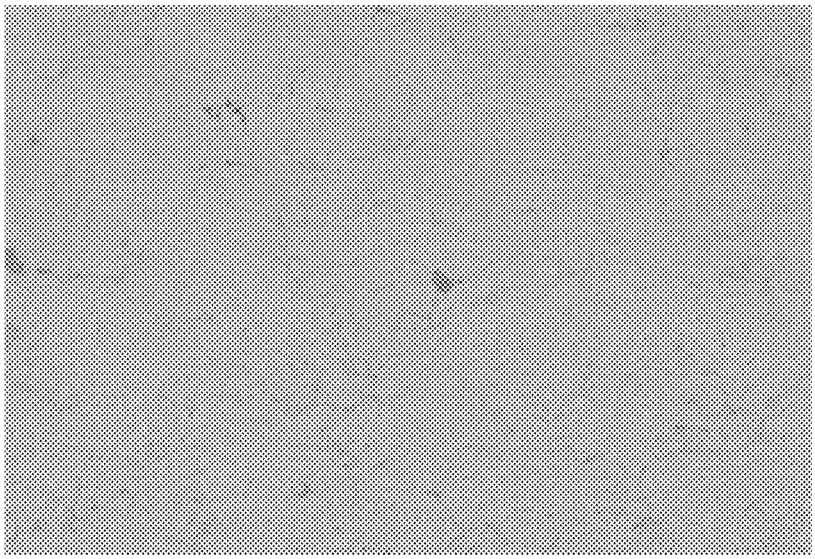
FIG. 7 illustrates a cross sectional SEM of a deposit, according to one more embodiment of the invention.

Nickel was deposited on stainless steel substrate using a slurry of 10 wt % of 2-3 μm size nickel powder in water. Propylene fuel was supplied to the gun at 83 psig and air was supplied at 85 psig. The combustion pressure was 70 psi. The gun was operated with a gun traversal speed of about 1.2 m/s at a distance of 6-7 cm from the substrate. About 12 microns were deposited per pass and the total deposit thickness was made to be about 480 microns. A cross-sectional SEM image in FIG. 7 showed that the deposit consisted primarily of bonded particles that had not previously melted. The average particle size was about 2 microns.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method of forming an article with a coating comprising:

providing a spray gun comprising a combustion chamber having an inlet side and an outlet side;

providing a combustion zone between the inlet side and outlet side of the combustion chamber;

providing a permeable burner block in the combustion zone;

providing a fuel and an oxidizer inside the combustion zone;

initiating combustion inside the combustion zone to form a combustion gas stream comprising combustion gases;

introducing a feedstock mixture comprising a feedstock material and a liquid carrier into the combustion gas stream present in the combustion chamber when the temperature of the combustion gas stream is greater than the melting point of the feedstock material, creating an entrained feedstock stream and expelling the entrained feedstock stream from the spray gun through a nozzle to form a coating on a surface of the article, wherein the feedstock material is maintained at a temperature below its melting point by the liquid carrier when the feedstock mixture is introduced into the combustion chamber, and during spraying of the feedstock material so that the feedstock material does not melt during spraying; and wherein the median particle size of feedstock material is less than about 10 microns, and the feedstock material comprises a metal or a metal alloy.

2. The method of claim 1, wherein the feedstock mixture comprises at least 10 wt % of liquid.

3. The method of claim 2, wherein the feedstock mixture comprises at least 50 wt % of liquid.

4. The method of claim 1, wherein the liquid comprises water, organic liquids, oils, alcohols, or combinations thereof.

5. The method of claim 1, wherein the spray gun is an high-velocity-air-fuel gun.

6. The method of claim 1, wherein the temperature of the feedstock material is maintained below about 0.9 times the melting point of the feedstock material.

7. The method of claim 1, wherein the fuel comprises a gas from propylene, propane, methane, butane, natural gas, hydrogen or mixtures thereof.

8. The method of claim 1, wherein the oxidizer comprises air or oxygen.

9. The method of claim 1, wherein the feedstock material comprises nickel, cobalt, titanium, aluminum, zirconium, copper, nickel-base alloys, cobalt-base alloys, titanium-base alloys, iron-base alloys, steels, stainless steels, and aluminum-base alloys and combinations thereof.

10. The method of claim 1, further comprising preparing the article surface to receive the feedstock material, wherein preparing the article surface comprises removing material from the surface to form a prepared region and depositing the feedstock material on the prepared region.

11. The method of claim 1, wherein the feedstock mixture is introduced along the centerline axis of the combustion chamber.

12. The method of claim 1, wherein the feedstock mixture is introduced through a coaxial tube injection port comprising an inner tube and an outer tube.

13. The method of claim 12, wherein the feedstock is introduced through the inner tube and the liquid is introduced through the outer tube.

* * * * *